United States Patent [19]

Grosse et al.

[11] Patent Number: 4,695,687

[45] Date of Patent: Sep. 22, 1987

[54] CONTACT ARRANGEMENT FOR VACUUM SWITCHES WITH AXIAL MAGNETIC FIELD, AND METHOD FOR THE PRODUCTION OF THE RESPECTIVE CONTACT PIECES

[75] Inventors: Joachim Grosse, Erlangen; Ruediger Hess, Berlin; Wilfried Kuhl, Wendelstein; Reiner Mueller, Steinbach, all of Fed. Rep. of Germany

[73] Assignee: Siemens Aktiengesellschaft, Berlin and Munich, Fed. Rep. of Germany

[21] Appl. No.: 29,502

[22] Filed: Mar. 23, 1987

[30] Foreign Application Priority Data

Mar. 26, 1986 [DE] Fed. Rep. of Germany ..... 3610243

[51] Int. Cl.[4] ..... H01H 33/66

[52] U.S. Cl. ..... 200/144 B

[58] Field of Search ..... 200/144 B

[56] References Cited

U.S. PATENT DOCUMENTS 4,246,458 1/1981 Yanabu ..... 200/144 B 4,430,536 2/1984 Kurosawa et al. ..... 200/144 B 4,532,391 7/1985 Bernt ..... 200/144 B 4,588,879 5/1986 Noda et al. ..... 200/144 B

*Primary Examiner*—Robert S. Macon

*Attorney, Agent, or Firm*—John Francis Moran

[57] ABSTRACT

Contact pieces for vacuum switches with axial magnetic field are designed, for example, as pot type contacts with codirectional slotting which contain in each instance a disk-shaped contact body of contact material and have an arrangement for the suppression of eddy currents. Conventional techniques for this purpose typically involves the cutting of radial slots in the contact bodies. In accordance with the invention, each contact piece (10, 110, 210) comprises a plurality of discrete elements (11, 111, 211) which are so arranged on the concrete carrier (2) that their edges (12, 13; 112, 113; 212, 213) form joints (25, 125, 225) and thereby define conductivity jumps for the suppression of the eddy currents. Specifically the discrete segments (111, 211) are produced by reshaping a cylindrical blank (100) of circular cross section into a semi-finished product of circular sectorial cross section.

24 Claims, 6 Drawing Figures

CONTACT ARRANGEMENT FOR VACUUM SWITCHES WITH AXIAL MAGNETIC FIELD, AND METHOD FOR THE PRODUCTION OF THE RESPECTIVE CONTACT PIECES

BACKGROUND OF THE INVENTION

This invention relates to a contact arrangement for vacuum switches having an axial magnetic field, and it relates, more particularly, to the contact pieces of the type containing disk type contact bodies wherein the contact bodies are soldered on contact carriers and have means for reducing eddy currents. In addition, the invention relates to techniques and methods for the production of the respective contact pieces.

With the increasing applications and the adaption of the vacuum switching principle to the medium voltage range, the control of larger breaking currents has become mandatory. Even for currents above 40 kA to be switched off safely, there is the concurrent requirement to maintain the outer dimensions of the switching tube unchanged or even to reduce them. A great number of specific contact geometries have been proposed, which guide the switching current in the vicinity of the contact bodies in azimuthal direction. Thereby an axial magnetic field is produced during switching between the contact pieces and thus a switching arc that is uniformly distributed and diffused over the entire contact surface is developed.

In conventional contact configurations for developing a axial magnetic field the following problems tends to occur. Due to the time variation of the current in the azimuthal current path, eddy currents are induced in closed annular contact carrier bottoms, in disk type contact bodies, or also in contact rings. Such eddy currents produce secondary magnetic fields which tend to weaken the axial magnetic field in amplitude and cause shifts in its phase relative to the current flowing through the switch. The phase shift of the axial magnetic field results in, however, that during and after the zero crossing of the current a considerable axial residual magnetic field remains. This magnetic field prevents the rapid discharge of the still existing charge carriers from the contact gap and supports an undesired re-ignition of the arc.

In the prior art various techniques and arrangements for preventing eddy currents in vacuum switches with axial magnetic field are know. In German patent document DE-PS 24 43 141, for example, a contact arrangement is disclosed in which there are four current conductors extending radially and azimuthally in the form of a hook to produce the axial magnetic field, and the disk type contact body is radially slotted to avoid eddy currents. From German patent document DE-OS 32 31 593, a different construction of a contact from azimuthal current conductors is disclosed which are formed by a multiple codirectional slotting of a pot-shaped contact, onto which is soldered a contact disk provided with radial slots, as contact body. In European patent document EP-A-00 55 008, furthermore, the course of current conductors for magnetic field production is illustrated, where the current flows in the contact disk in multiple meanders in the plane of the arc and the contact body is divided by wide slits into several parts.

In the technical literature, (for example, IEEE Transactions on Power Apparatus and Systems (1980), pages 2079 to 2085), it is stated under what conditions slits are required to prevent eddy currents in the contact disk exposed to the arc, the necessity of such slits being generally assumed in the practice.

A disadvantage in conventional arrangements because of the wide radial slits in the contact surface toward the arc cathode bases preferentially start at the edges thereof, which due to overheating may lead to re-ignition. Moreover, in the state of the art, the slotting of the disks is limited to about one third of the contact disk diameter for the purpose of maintaining the stability of the contact body. Because of the absence of slotting in the central region of the contact disks, the eddy currents flowing there remain fully effective.

SUMMARY OF THE INVENTION

It is, therefore, an object of the present invention to provide contacts for vacuum switches having an axial magnetic field wherein eddy currents and axial residual magnetic fields coupled therewith are largely prevented in the zero crossing of the current, without the requirement of providing interfering slits on the contact surface of the contact body.

In accordance with the invention, it is proposed to use in axial field contact systems contact bodies which provide a desired reduction of the eddy currents by the fact that several discrete elements are applied on the contact carrier in such a way that through the joints they define conductivity jumps. In this connection it is advantageous that in the contact surface itself, at the joints, only thin gaps exist, which can extend to the center of the disk and which, compared to conventional slits, ensure the same or even an improved effect. Preferably the entire contact disk is composed of several identical sectorial disk segments which are soldered on the contact carrier which produces the axial field. The presence of a bevel on the radially extending edges of the discrete elements, a wedge-shaped cross section of the radial joints may thus be formed on the back.

In accordance with further aspects of the invention, different manufacturing methods are proposed for the contact pieces: For instance, the individual segments may be made by chipping or chipless shaping. By a particularly adapted arc remelting method on copper-chromium (CuCr) contact material and subsequent reshaping, segments of circular sector-shaped cross section are produced from circular-cylindrical blanks. In each individual segment, additional conductivity jumps can be obtained by chromium-containing veins in an annular arrangement. In addition to the wedge-shaped joint, such veins provide a further reduction of the eddy currents. Another possibility is to utilize the concentric chromium veins in the blank in such a way that after division into sectorial segments, they form together with the segment edges in the discrete element trapezoidal ring sections.

By adding iron (Fe) or aluminum (Al) as additional components to the contact material, it is possible to produce in a controlled manner segregations of Fe or Al at the edge of the blank. These too provide conductivity jumps in the disks composed of discrete elements. For this purpose, CuCr blanks can be reshaped specifically in an iron tube by forward extrusion, so that an iron skin is produced at the circumference of the semi-finished product for the sectorial segments. Furthermore, the CuCr blank may, before being reshaped, be coated in a controlled manner with lower conductor materials (for instance Fe, Ni, Co Ti), so that intensified conductivity jumps result between the segments.

BRIEF DESCRIPTION OF THE DRAWING

Further details and advantages of the invention will become apparent from the following description of illustrative embodiments of the invention considered with the drawing.

DETAILED DESCRIPTION

Figure 1:
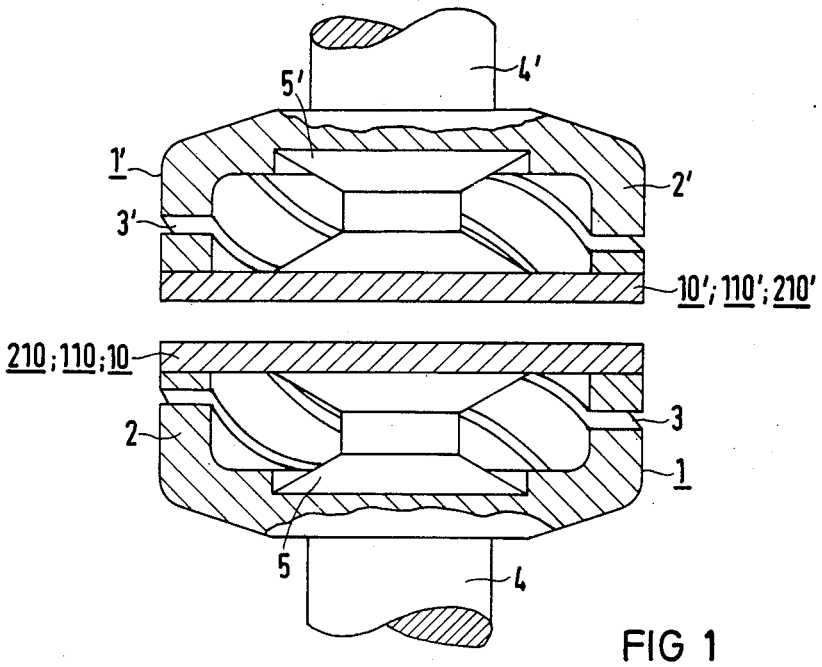
FIG. 1 illustrates a contact arrangement for vacuum switchgear having an axial magnetic field in a cross sectional view.

In FIG. 1, a contact piece 1 of a vacuum switch comprises a pot-like contact carrier 2 having obliquely extending peripheral slotting 3. The counter contact piece 1' has in the corresponding contact carrier 2' a slotting 3' in axial direction extending in the same direction as the slotting 3, so that due to the current flow an axial magnetic field results. Providing electrical connection to the contact carrier 2, 2' is a contact pin 4, 4' of copper or similar high conductivity metal. In the contact carrier 2, 2' a supporting body 5, 5' of lower conductivity material, for example, chromium/nickel steel in double T form, is inserted.

Included in this arrangement is for example a contact disk 10, 10' of suitable contact material, for example, a CuCr material having 50% Cr. In the state of the art the contact body normally consists of a disk in which, starting from the periphery, slots are made extending radially toward the center as far as possible. The center of disk 10 can not be slotted, to ensure sufficient stability of the entire contact piece.

Figure 2:
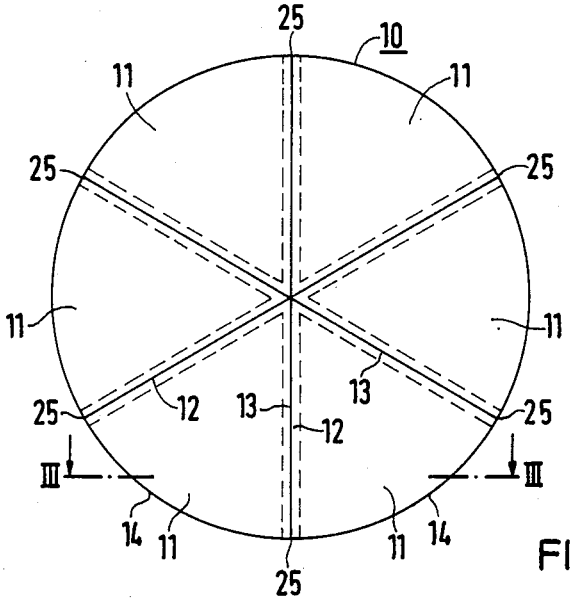
FIG. 2 depicts a top view of a segmented contact body suitable for use in FIG. 1.

It is evident from FIG. 2 that the contact body 10 includes six identical discrete elements 11, each having a sector-shaped base with radial edges 12 and 13 and a segmental circumference 14, the edges 12 and 13 form a center angle of sixty degrees. The six discrete elements 11 are fitted together so that together they form a circular disk, in which two edges 12 and 13 are parallel and form radial joints 25. In azimuthal direction the disk is expediently oriented and soldered onto the slotted contact carrier 2 in such a way that the radial joints 25 are correspondingly associated with the slotting 3, 3'.

The individual segments 11 may be produced by chipping or chipless shaping. According to FIG. 3, the segments 11 are advantageously beveled at the radially extending edges 12 and 13, with the bevel of each edge 13 and 15 to the perpendicular being possibly between five degrees and forty-five degrees, for example, fifteen degrees. By the fitting together of two segments 11 with corresponding bevels there results a wedge open toward the back of the contact of approximately thirty degrees, for example. The wedge angle, alpha, between two adjacent segments 11 may range between ten degrees and ninety degrees. Wedge forms having a semicircular or rectangular profile are possible also.

As the segments 11 are being soldered onto the contact carrier 1 or respectively the supporting body 5 according to FIG. 1, the solder needed for the soldering of the segments does not fill the joints between the segments 11. Although on the surface of the contact body 10 a continuous area is formed, a sufficient conductivity jump is ensured at the same time by the rearward wedges 15.

Figure 4:
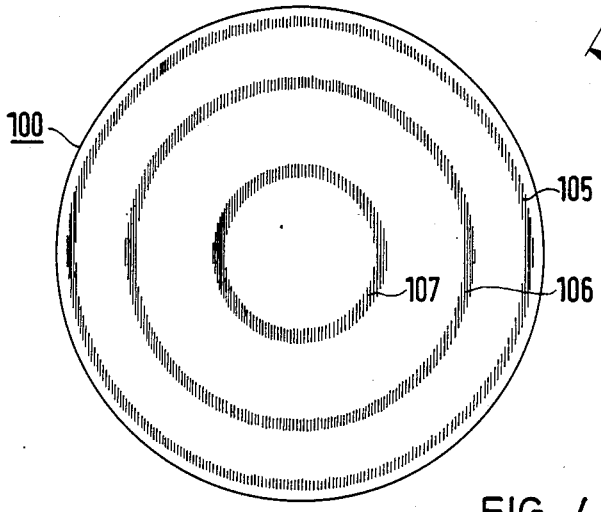
FIG. 4 is a side view of a cross section of a cylindrical blank of copper-chromium melt material.

By special manufacturing methods of the circular segments the conductivity jumps can be intensified at the joints, as will be explained with reference to FIG. 4 to FIG. 6.

When using CuCr melt materials, a cylindrical blank 100 can be produced by arc remelting. The metallographic section pattern of such a blank 100 shows that there are concentric chromium veins 105 and 107, which normally are rather undesirable for the production of contact materials as homogeneous as possible. In FIGS. 4 to 6 the chromium veins 105 to 107 are represented by shading. But in the practice they are less distinct and also irregular.

By division into segments of sectorial cross section and composition of the segments to form a circular disk, such contact bodies 110 can be made in which there are in the discrete element 111 radially tapering trapezoidal ring regions which are limited by the concentric chromium veins 105 to 107 on the one hand and the radial joints 125 of the segment edges 112 and 113 on the other hand. Such a structure can serve in optimum manner for the localization of the induced currents $I_R$ and hence compensation of the undesired eddy currents.

Figure 5:
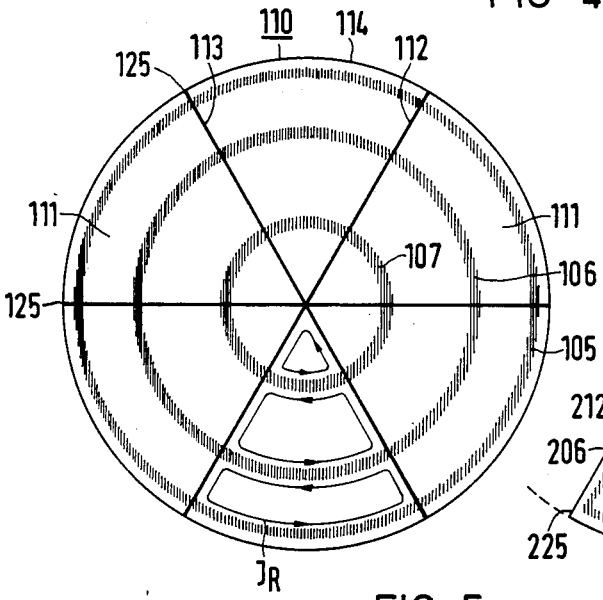
FIG. 5 illustrates a contact body having six segment type discrete elements.
Figure 6:
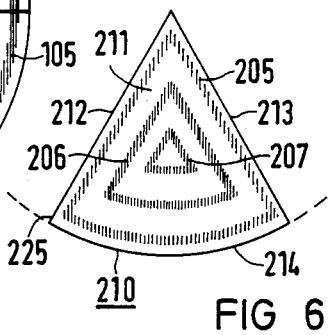
FIG. 6 is a contact segment in the form of a discrete element produced from the blank according to FIG. 4 by reshaping.

As an alternative to FIG. 5 it is possible to produce, by reshaping of the circular-cylindrical blank 100 to a semi-finished product with sector-shaped cross section, discrete segments 211 with chromium-containing veins 205 to 207 in ring-like arrangement, as is indicated in FIG. 6. Six discrete segments 211 form the entire disk type contact body 210. In particular by the ring 205 at the circumference of the segment 211, the development of eddy currents can thus be sufficiently reduced together with a possibly wedge-shaped joint 225 between the discrete segments 211.

Also with an obtuse joint between discrete segments, that is without a cuneiform gap, the eddy currents can already be reduced considerably, because the joint edges fused over in the switching process show cracks due to solidification contraction. This desirable fissuration reduces moreover shrinkage stresses in the contact disk which could otherwise lead to warping in the contact area. As an additional advantage specifically of a reshaped contact material it is found that due to the deformation of the material blank in axial direction, axially oriented Cr dendrites exist in the contact body 210 composed of the discrete elements 211, which ensure an especially high burnoff resistance and hence an increased thermal load capacity in the switching arc.

By addition of iron (Fe) and/or aluminum (Al) to the CrCu alloy it is possible to obtain in arc remelting even a controlled segregation of Fe or Al at the edge of the blank. After the reshaping of the blank to the semi-finished product with sectorial cross section for the discrete segments, this zone has a similar effect as a chromium vein, but brings about an electric conductivity jump in a much greater degree. In particular such segments can be butt-jointed and soldered to the contact carrier 2 and supporting body 5.

Figure 3:
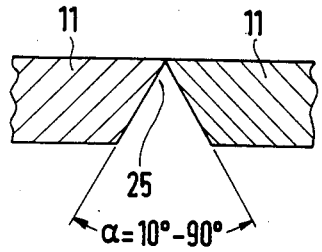
FIG. 3 is a cross sectional view taken along line III—III in FIG. 2.

Specifically in the latter form of realization, because of the much lower conductivity of the iron or of the alumimum, the wedge form on the back of the contact body according to FIG. 3 can be dispensed with.

In a modified manufacturing method, a CuCr blank can be reshaped in an iron tube by full forward extrusion to form sector-shaped semi-finished products. The segments separated therefrom have, caused by the manufacture, a poorly conducting iron skin, which, too, can be utilized advantageously as conductivity jump in the sense of the above statements. The same effect can be achieved by coating the blanks or semi-finished products with poorly conducting materials, for example iron (Fe), nickel (Ni), cobalt (Co) or titanium (Ti). The latter can take place with segments without reshaping according to FIG. 5 or with segments with reshaping according to FIG. 6.

Illustrative embodiments of the invention have been described in the foregoing for a CuCr based material containing 30 to 60% by volume chromium as contact material. Contacts according to the invention may be produced also from other material systems, for example on CuW or CuMo basis.

There has thus been shown and described novel vacuum contact arrangements which fulfill all the objects and advantages of the invention sought therefor. Many changes, modifications, variations and other uses and applications of the subject invention will, however, become apparent to those skilled in the art after considering this specification and the accompanying drawing which disclose the preferred embodiments thereof. All such changes, modifications, variations and other uses and applications which do not depart from the spirit and scope of the invention are deemed to be covered by the invention which is limited only by the claims which follow.

We claim:

1. A contact arrangement for vacuum switches having an axial magnetic field, the arrangement comprising: contact members including disk shaped contact bodies, contact carriers have the contact members soldered to them and including means for reducing eddy currents, the contact bodies comprising a plurality of discrete elements affixed to the contact carrier wherein their edges form joints that define conductivity jumps for suppression of the eddy currents.

2. A contact arrangement according to claim 1, wherein the joints of the discrete elements form on the back a wedge of group shapes including triangular, rectangular, and concave cross section.

3. A contact arrangement according to claim 2, wherein the discrete elements are beveled at their edges on the back, the bevel to the perpendicular relative to the contact surface being in the range between five degrees and forty-five degrees.

4. A contact arrangement according to claim 1, wherein the discrete elements are in the form of sectors and arranged about a central point having radially extending joints therefrom.

5. A contact arrangement according to claim 2, wherein the discrete elements are identical in shape.

6. A contact arrangement according to claim 2, wherein the discrete elements are sixty degree segments and that six elements together form the disk type contact piece.

7. A contact arrangement according to claim 1, wherein the discrete elements comprise a CuCr-based material.

8. A contact arrangement according to claim 7, wherein the CuCr material has a Cr volume content in the range of thirty to sixty percent Cr.

9. A contact arrangement according to claim 7, wherein the CuCr material is a material formed by arc remelting.

10. A contact arrangement according to claim 1, wherein additions of components of lower electric conductivity than the electrical conductivity of the base terminal are present in the contact body.

11. A contact arrangement according to claim 7, wherein additions of components of lower electric conductivity than the electrical conductivity of the base terminal are present in the contact body.

12. A contact arrangement according to claim 1, wherein the discrete elements comprise a CuCrFe material, the Cu content being in the range of fifty to sixty percent by volume, the Cr content having a range of twenty to fifty percent by volume, and the Fe content has a range of five to twenty-five percent.

13. A contact arrangement according to claim 7, wherein the material contains additionally small amounts of aluminum (Al).

14. A contact arrangement according to claim 10, wherein the material contains additionally small amounts of aluminum (Al).

15. A contact arrangement according to claim 12, wherein the material contains additionally small amounts of aluminum (Al).

16. A contact arrangement according to claim 6, wherein in each segment-like discrete element the lower conductor component is precipitated concentric to the center of the contact body formed by six segments and defines additional radial conductivity jumps on the contact body.

17. A contact arrangement according to claim 1, wherein in each discrete element includes a lower poorer conductor component of the contact material being precipitated in ring form and thereby defines, in particular close to the segment circumference, additional ring type conductivity jumps.

18. A contact arrangement according to claim 4, wherein in each discrete element includes a lower poorer conductor component of the contact material being precipitated in ring form and thereby defines, in particular close to the segment circumference, additional ring type conductivity jumps.

19. A contact arrangement according to claim 12, wherein in each discrete element includes a lower poorer conductor component of the contact material being precipitated in ring form and thereby defines, in particular close to the segment circumference, additional ring type conductivity jumps.

20. A contact arrangement according to claim 16, wherein in each discrete element includes a lower poorer conductor component of the contact material being precipitated in ring form and thereby defines, in particular close to the segment circumference, additional ring type conductivity jumps.

21. A method for the production of contact pieces for a contact arrangement comprising the steps of: soldering sector-shaped discrete elements onto a contact carrier arc remelting to form contact material, the arc remelting of a cylindrical blank of circular cross-section the blank by reshaping to a semi-finished product having with segment-shaped cross-section wherein the discrete elements have axially oriented Cr dendrites separating them.

22. A method according to claim 21, wherein the reshaping of the CuCr blank uses an iron tube by full forward extrusion to form a semi-finished product, whereby the semi-finished product is covered by a layer of iron.

23. A method according to claim 21, wherein the CrCu blank is coated with a material of lower electric conductivity from the group comprising iron (Fe), nickel (Ni), cobalt (Co) or titanium (Ti).

24. A method according to claim 21, wherein the semi-finished product is coated with a material of lower electric conductivity from the group comprising iron (Fe), nickel (Ni), cobalt (Co) or titanium (Ti).

* * * * *